US008915388B2

(12) United States Patent
Rice

(10) Patent No.: US 8,915,388 B2
(45) Date of Patent: Dec. 23, 2014

(54) VIAL WITH PUSH-BUTTON RELEASE CLOSURE

(75) Inventor: Chad E. Rice, Lititz, PA (US)

(73) Assignee: Berry Plastics Corporation, Evansville, IN (US)

( * ) Notice: Subject to any disclaimer, the term of this patent is extended or adjusted under 35 U.S.C. 154(b) by 519 days.

(21) Appl. No.: 12/703,035

(22) Filed: Feb. 9, 2010

(65) Prior Publication Data

US 2010/0200533 A1 Aug. 12, 2010

Related U.S. Application Data

(60) Provisional application No. 61/151,416, filed on Feb. 10, 2009.

(51) Int. Cl.

| | |
|---|---|
| ***B65D 55/02*** | (2006.01) |
| ***B65D 50/08*** | (2006.01) |
| ***B65D 43/04*** | (2006.01) |
| ***B65D 50/04*** | (2006.01) |

(52) U.S. Cl.
CPC ..... *B65D 50/046* (2013.01)
USPC ..... 215/216; 215/217; 215/218; 215/221; 215/209; 220/281

(58) Field of Classification Search
CPC ..... B65D 41/0471; B65D 41/0485; B65D 50/04; B65D 50/045; B65D 50/046; B65D 50/066
USPC ..... 215/216, 217, 218, 221, 209; 220/281
See application file for complete search history.

(56) References Cited

U.S. PATENT DOCUMENTS

| | | | | |
|---|---|---|---|---|
| 3,884,379 | A | 5/1975 | Landen | |
| 4,036,385 | A | 7/1977 | Morris | |
| 4,103,797 | A | 8/1978 | Morris | |
| 5,165,559 | A | 11/1992 | Kusz | |
| 5,511,677 | A | 4/1996 | Oder | |
| 5,711,442 | A | 1/1998 | Kusz | |
| 5,816,422 | A | 10/1998 | Roig | |
| 5,899,348 | A | 5/1999 | Konefal et al. | |
| 5,941,402 | A | 8/1999 | Krueger | |
| 6,039,195 | A | 3/2000 | Konefal et al. | |
| 6,327,770 | B1 | 12/2001 | Konefal et al. | |
| 6,508,373 | B1 * | 1/2003 | Robinson | 215/209 |
| 7,401,706 | B2 | 7/2008 | Shingle | |
| 2005/0103741 | A1 | 5/2005 | Shingle | |

* cited by examiner

*Primary Examiner* — Fenn Mathew
*Assistant Examiner* — Andrew T Kirsch
(74) *Attorney, Agent, or Firm* — Barnes & Thornburg LLP

(57) ABSTRACT

A child-resistant package includes a vial and a closure configured to mount on the vial to cover a mouth opening into a product-storage chamber of the vial. A child-resistant feature cooperates with the closure and the vial to prevent unwanted removal of the closure from the vial.

13 Claims, 6 Drawing Sheets

FIG. 1
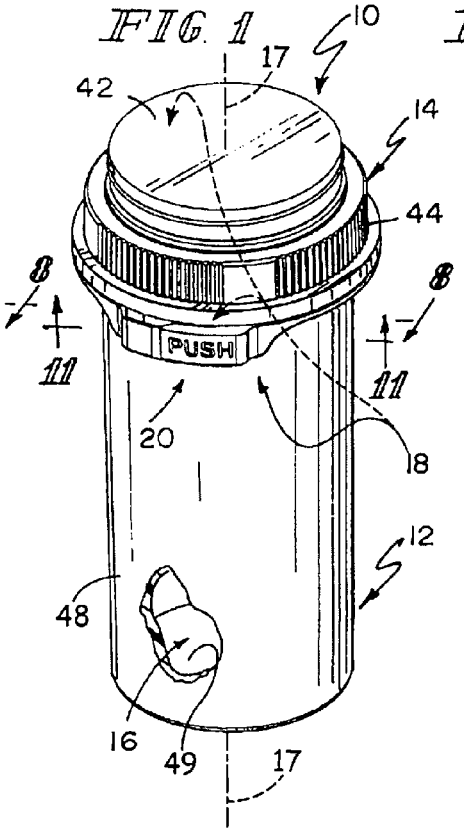
FIG. 2
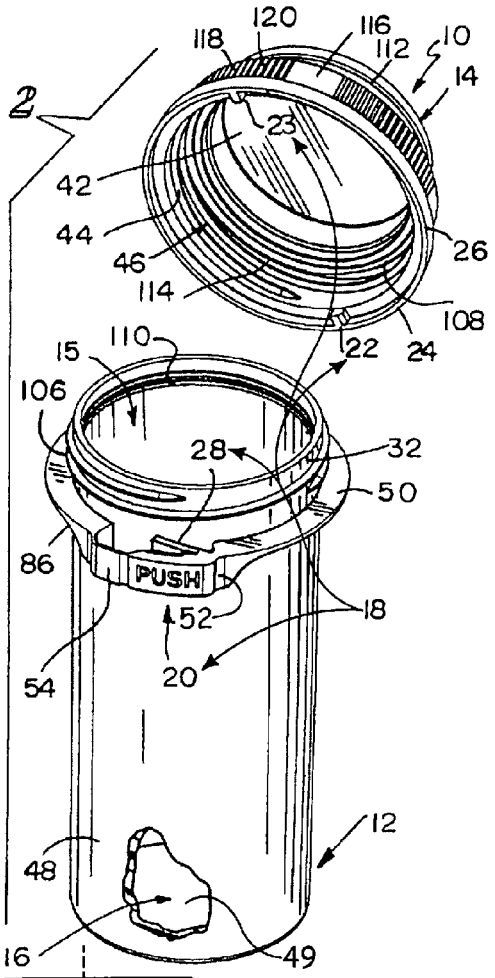
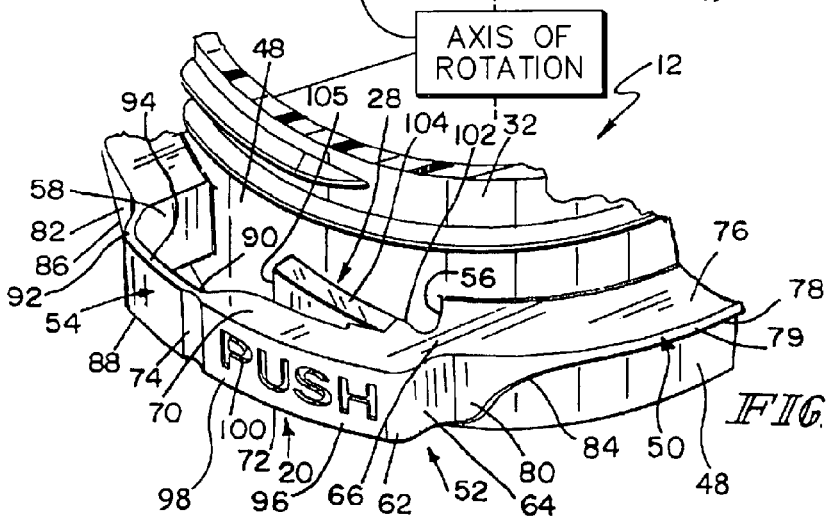
FIG. 3

VIAL WITH PUSH-BUTTON RELEASE CLOSURE

This application claims priority under 35 U.S.C. §119(e) to U.S. Provisional Application Ser. No. 61/151,416, filed Feb. 10, 2009, which is expressly incorporated by reference herein.

BACKGROUND

The present disclosure relates to medical packaging, and particularly to child-resistant packaging. More particularly, the present disclosure relates to child-resistant packaging that includes a release element used to release the closure from the vial.

Child-resistant packaging is used to store products such as medicine. To prevent unwanted opening by children, such packaging is often configured to require multiple actions to remove a closure from a companion vial.

SUMMARY

According to the present disclosure, a child-resistant package comprises a vial and a closure removably coupled to the vial to cover a mouth opening into a product-storage chamber of the vial. The child-resistant package includes a child resistant feature designed to prevent unwanted removal of the closure from the vial.

In illustrative embodiments, the child-resistant package includes a closure-release control mechanism having a movable release element that is coupled to the vial and configured to permit the release of the closure from the vial upon the application of a radially inwardly directed force to the movable release element by a consumer. The closure-release control mechanism also includes a pair of rotation-blocking stops coupled to a rim of the closure. The movable release element includes an upwardly sloping locking tab that is configured to engage one of the rotation-blocking stops to block the removal of the closure from the vial until a radially inwardly directed force is applied by a consumer to the movable release element carried on the vial.

Additional features of the disclosure will become apparent to those skilled in the art upon consideration of the following detailed description of illustrative embodiments exemplifying the best mode of carrying out the disclosure as presently perceived.

BRIEF DESCRIPTION OF THE DRAWINGS

The detailed description particularly refers to the accompanying figures in which:

FIG. 1 is a perspective view of a child-resistant package in accordance with the present disclosure showing a vial, a closure mounted on the vial to cover a mouth opening into an interior region formed in the vial, and a closure-release control mechanism having a movable release element (labeled PUSH) that is coupled to the vial and configured to disengage a locking tab coupled to the vial from a rotation-blocking stop included in the closure to permit the release of the closure from the vial upon the application of a radially inwardly directed push force to the movable release element by a consumer as suggested in FIGS. 7, 12, 12*a*, and 13;

FIG. 2 is an exploded view of the child-resistant package of FIG. 1, showing the closure separated from the vial to reveal a pair of cube-shaped rotation-blocking stops coupled to a perimeter edge of a rim of the closure and showing the movable release element coupled to an annular flange of the vial and an inclined locking tab included in the closure-release control mechanism and configured to engage one of the rotation-blocking stops in the closure as suggested in FIGS. 6, 10, and 11 to block removal of the closure from the vial until a radially inwardly directed push force is applied to the movable release element;

FIG. 3 is an enlarged perspective view of the vial of FIG. 2, with portions broken away, showing the inclined locking tab positioned to lie between the movable release element and an annular side wall included in the vial and showing that the movable release element is supported by an element hinge along a right side and a pliable web along a left side to permit radially inward movement of the movable release element and locking tab toward the annular side wall of the vial in response to application of a radially inwardly directed push force to the movable release element;

FIGS. 3B-6 are a series of perspective views showing installation of the closure on the vial to cause one of the cube-shaped rotation-blocking stops on the closure to pivot and mate with one of the inclined locking tabs on the vial to limit rotation of the closure relative to the vial in a counterclockwise closure-removal direction;

FIG. 3B is an enlarged internal partial perspective view of the child-resistant package of FIGS. 1-3 showing a cube-shaped rotation-blocking stop included in the closure moving (to the right) toward the cantilevered locking tab, with a portion thereof broken away to show a gap formed between the locking tab and the movable release element;

FIG. 4 is a partial perspective view similar to FIG. 3A showing the rotation-blocking stop as it is moved toward the locking tab of the closure-release control mechanism during movement of the closure in a clockwise closure-installation direction to install the closure on the vial;

FIG. 5 is a partial perspective view similar to FIGS. 3A and 4 showing the rotation-blocking stop engaging and moving the locking tab in a downward direction about the horizontal pivot axis in response to further rotational movement of the closure with respect to the vial in the clockwise closure-installation direction;

FIG. 6 is a partial perspective view similar to FIGS. 3A-5 showing the locking tab in a locked position in the pathway of the rotation-blocking stop included in the closure after the rotation-blocking stop has cleared the end of the locking tab and the elastic locking tab has snapped back (i.e., pivoted upwardly about the horizontal pivot axis) to resume its initial position to prevent removal of the closure from the vial;

FIG. 8 is an enlarged partial sectional view of the child resistant closure taken along line 8-8 of FIG. 1 showing the rotation-blocking stop moving in a clockwise closure-installation direction toward a sloped upper surface of the locking tab;

FIG. 9 is a partial sectional view similar to FIG. 8 showing the rotation-blocking stop engaging the sloped upper surface of the locking tab to cause the locking tab to deflect and move about the horizontal pivot axis in a downward direction;

FIG. 10 is a partial sectional view similar to FIGS. 8 and 9 showing the rotation-blocking stop located past the locking tab with the locking tab positioned in the pathway of the rotation-blocking stop to block movement of the closure in the counterclockwise closure-removal direction relative to the vial;

FIG. 11 is a partial transverse sectional view of the child-resistant closure taken along line 11-11 of FIG. 1 showing the locking tab in the locked position blocking the pathway of the rotation-blocking stop to block removal of the closure from the vial;

FIG. 12 is a sectional view similar to FIG. 11 showing the release element being depressed radially inwardly by a finger of a consumer to position the locking tab to lie radially inwardly of the rotation-blocking stop to the released position to allow for removal of the closure;

FIG. 13 is a sectional view similar to FIGS. 11 and 12 showing the rotation-blocking stop being rotated past the locking tab to allow for removal of the closure from the vial.

DETAILED DESCRIPTION

Figure 3B:
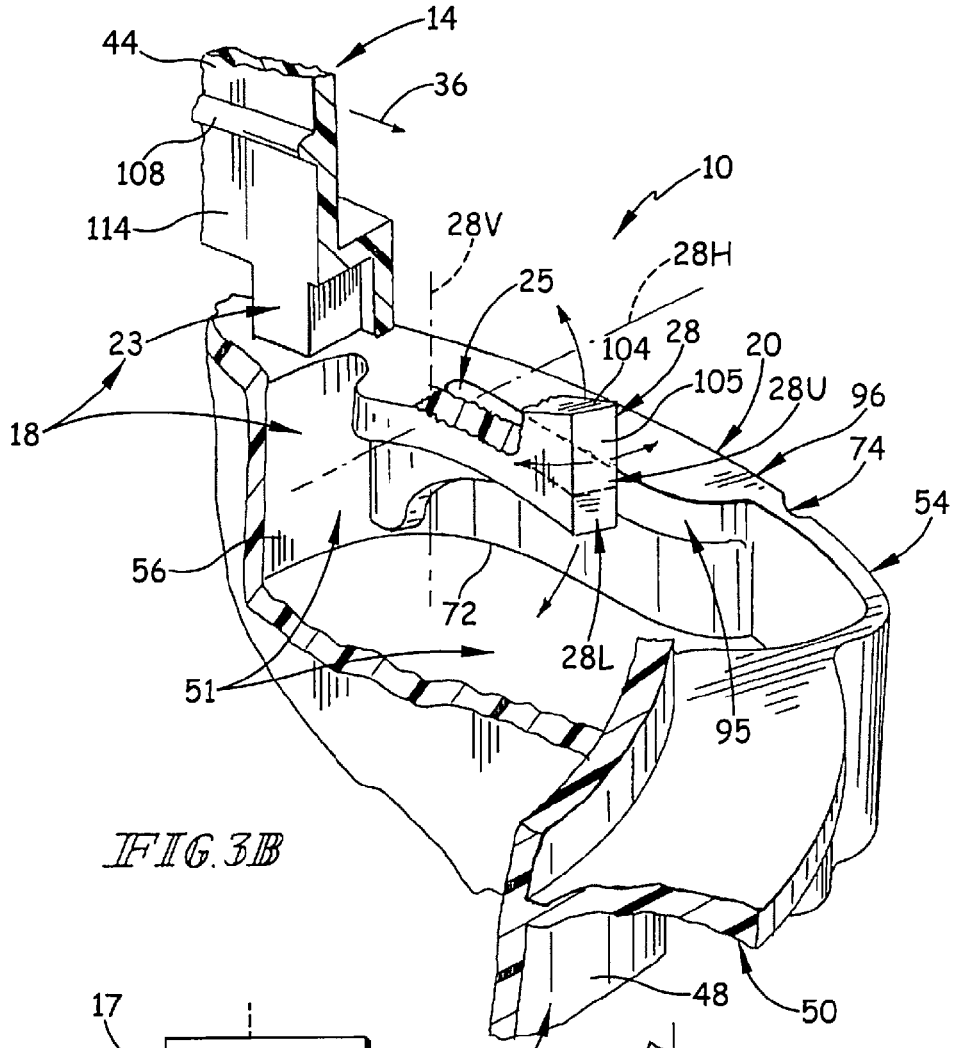

A child-resistant package 10 includes a vial 12 and a closure 14 mounted on vial 12 to cover a mouth 15 opening into a product-storage chamber 16 formed in vial 12, as shown in the illustrative embodiment of FIGS. 1 and 2. Child-resistant package 10 also includes a closure-release control mechanism 18 configured to control release of closure 14 from vial 12.

Figure 5:
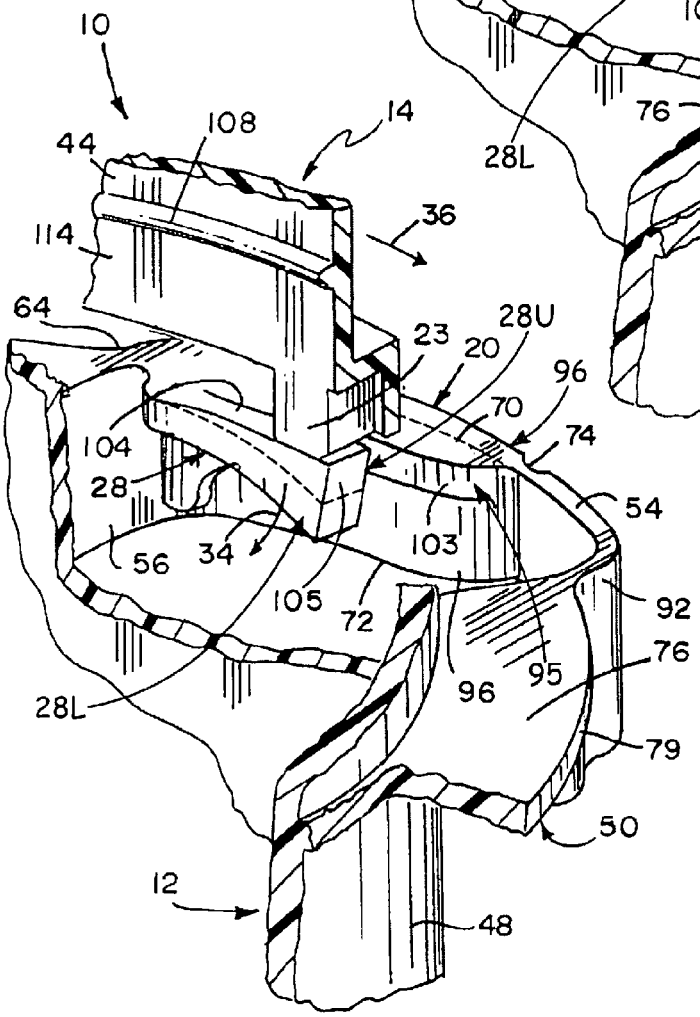
Figure 6:
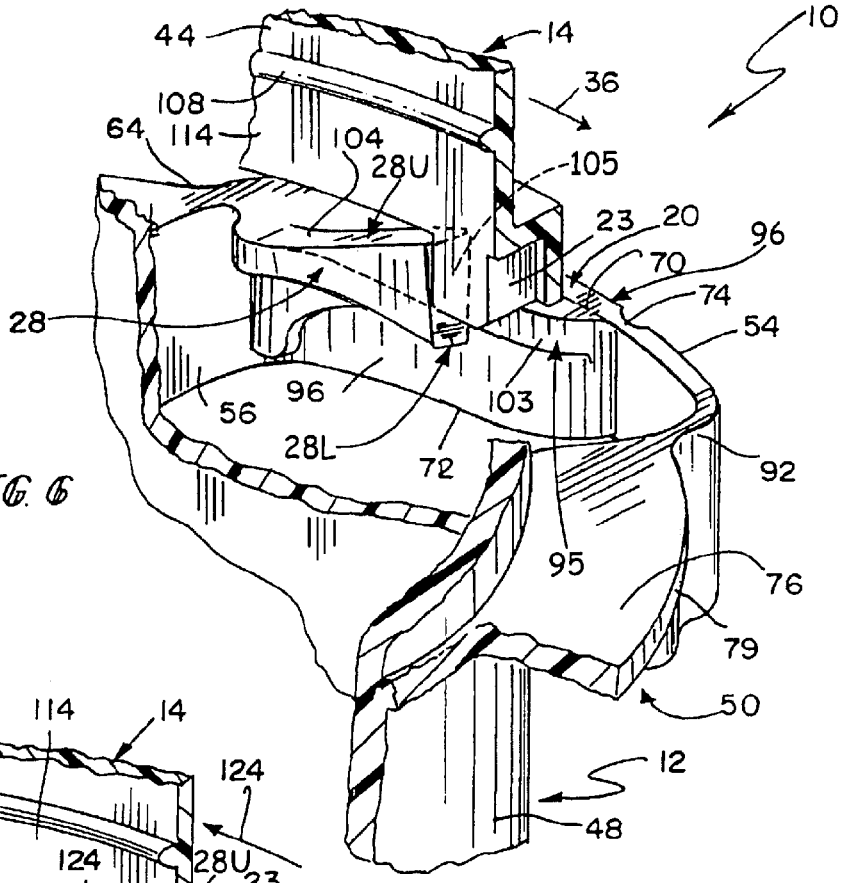
Figure 7:
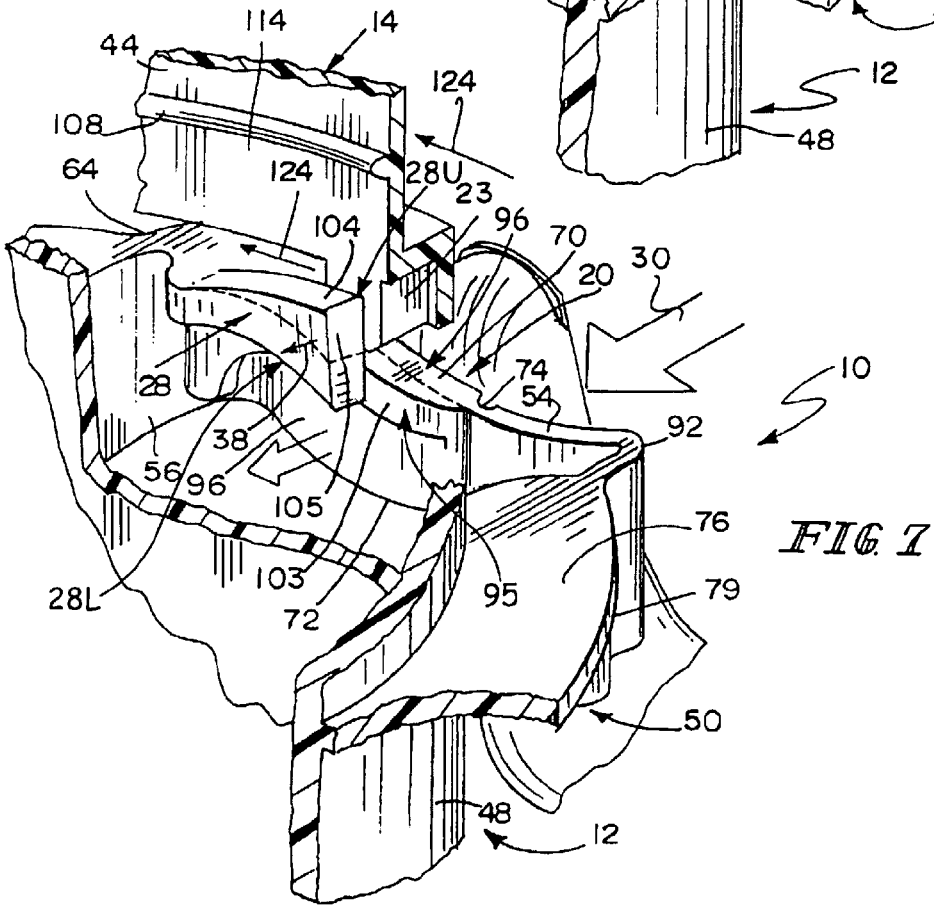
FIG. 7 is a perspective view similar to FIGS. 3A-6 during removal of the closure from the vial showing radially inward movement of the locking tab in response to radially inward movement of the movable release element to cause the rotation-blocking stop on the closure to unmate from the locking tab and showing subsequent counterclockwise rotation of the closure and the rotation-blocking stop after the stop disengages the locking tab to permit removal of the closure from the vial.
Figure 12:
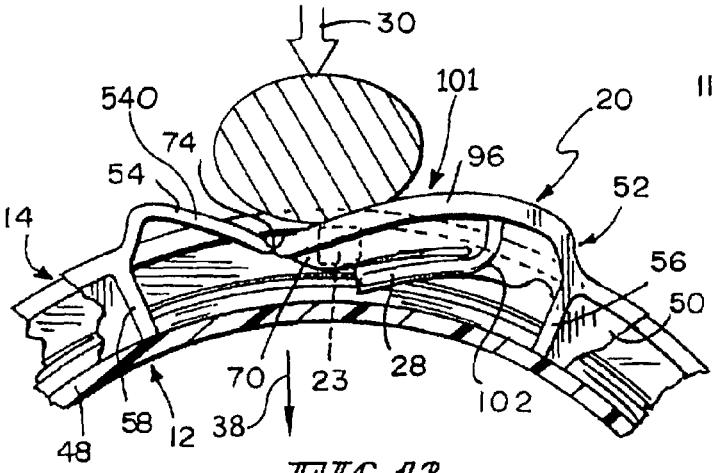
Figure 13:
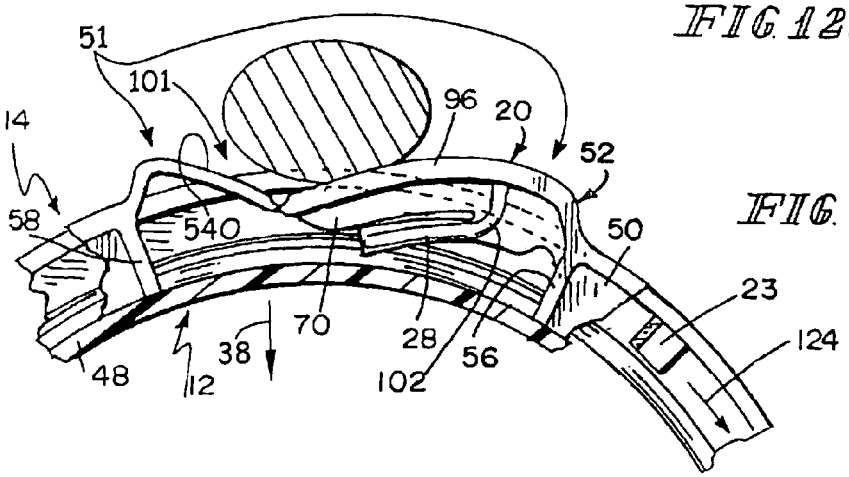

Closure-release control mechanism 18 comprises a movable release element 20 coupled to vial 12 and a locking tab 28 mounted on vial 12 for two-axis pivotable movement about a horizontal pivot axis 28H during installation of closure 14 on vial 12 and about a vertical pivot axis 28V during removal of closure 14 from vial 14. Closure-release control mechanism 18 further comprises a pair of radially inwardly extending rotation-blocking stops 22, 23 coupled to a rim 26 of closure 14, as shown in FIGS. 2, 3-3B, and 4-7. Removal of closure 14 from vial 12 is prevented when locking tab 28 included in closure-release control mechanism 18 and coupled to movable release element 20 is positioned to lie in the pathway of rotation-blocking stops 22, 23, as shown in FIGS. 4-6 and FIGS. 8-10. When a consumer pushes movable release element 20 in a radially inwardly direction 30, locking tab 28 moves out of the pathway of rotation-blocking stops 22, 23 on closure 14 to permit counterclockwise rotation and removal of closure 14 from vial, as shown in FIGS. 7, 12, and 13.

Closure 14 is arranged to be coupled to vial 12 after rotation of closure 14 about axis of rotation 17, as shown, for example, in FIG. 1. In illustrative embodiments, vial 12 includes an upwardly opening product-storage chamber 16 and a filler neck 32, as shown in FIG. 2. Filler neck 32 is adapted to accept closure 14 to seal in the contents of vial 12. Product-storage chamber 16 is adapted to contain product, such as medication, and is sealed when closure 14 is coupled to filler neck 32 of vial 12. Vial 12 also includes an annular side wall 48 coupled to filler neck 32, a floor 49 coupled to side wall 48, and an outwardly extending annular flange 50 coupled to side wall 48 and positioned to lie near filler neck 32 as suggested in FIG. 2.

Vial 12 includes a release-element support 51 coupled to an exterior surface of annular side wall 48 and configured to provide means for supporting movable release element 20 for radial movement relative to vertical axis of rotation 17 and to annular side wall 48 as shown, for example, in FIGS. 3, 7, and 11-13. In an illustrative embodiment, release-element support 51 includes first and second wall members 56, 58, element hinge 52, and web 54 as suggested in FIGS. 3, 3A, and 3B. First wall member 56 is coupled to annular side wall 48 and arranged to extend outwardly from side wall 48 as suggested in FIGS. 3B and 11. Second wall member 58 is coupled to annular side wall 48 and arranged to extend outwardly from side wall 48 and to lie in spaced-apart relation to first wall member 56 to locate movable release element 20 therebetween as suggested in FIGS. 3 and 11. Element hinge 52 is coupled to first wall member 56 and to one end of movable release element 20 as suggested in FIGS. 3 and 11. Web 54 is coupled to second wall member 58 and to an opposite end of movable release element 20 as suggested in FIGS. 3, 3A, and 11.

Annular flange 50 of vial 12 includes a top surface 76, a bottom surface 78, and a perimeter edge 79. Annular flange 50 is curved and extends around annular side wall 48 from first side wall 56 to second side wall 58 and away from movable release element 20 and web 54 as suggested in FIGS. 2 and 3.

Vial 12 also includes first and second tapered skirts 80, 82 that taper towards movable release element 20. Tapered skirts 80, 82 include sloping bottom edges 84, 86 that slope from wall members 56, 58 toward bottom surface 78 of annular flange 50.

Movable release element 20 of closure-release control mechanism 18 is coupled to first and second wall members 56, 58 by element hinge 52 and web 54, as shown, for example, in FIG. 3. Element hinge 52 and web 54 cooperate to allow for radially inwardly movement of movable release element 20 to engage and move locking tab 28 in an inward direction to disengage rotation-blocking stop 23 as suggested in FIGS. 7 and 12*a*. Inward movement of movable release element 20 toward axis of rotation 17 allows for the release of closure 14 from vial 12.

Figure 3A:
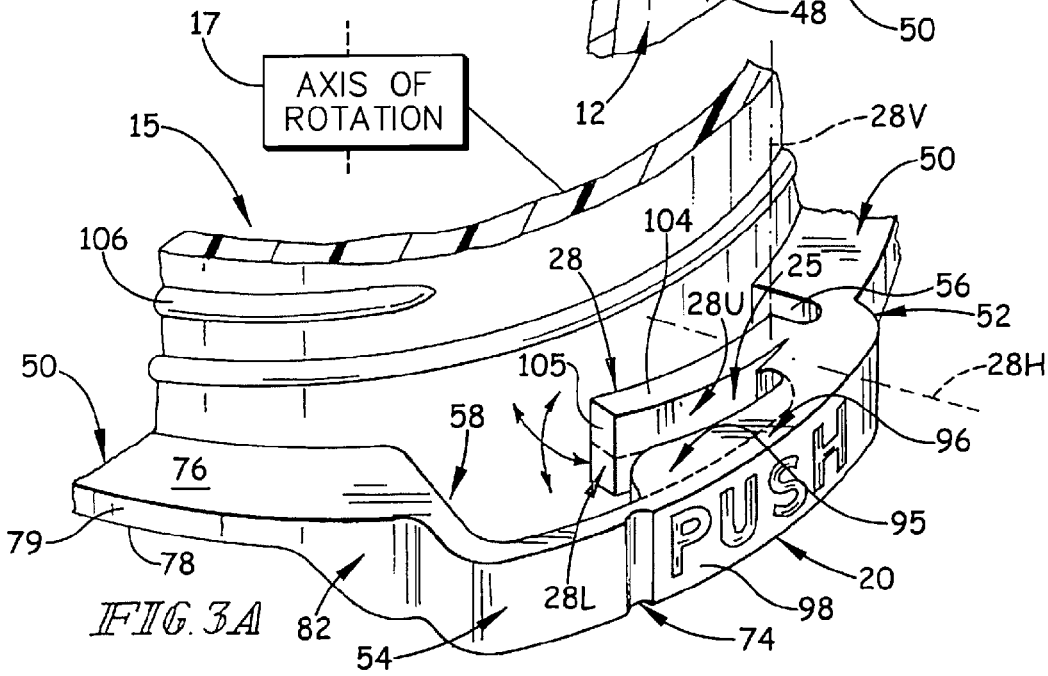
FIG. 3A is an enlarged external partial perspective view of the vial of FIGS. 1-3 showing the vial and components included in the closure-release control mechanism and suggesting that the locking tab is cantilevered for axially up-and-down pivotable movement of the locking tab about a horizontal pivot axis and for radially inward-and-outward pivotable movement of the locking tab about a vertical pivot axis.

Movable release element 20 includes a tab mover 95 and a mover actuator 96, as shown, for example, in FIGS. 3, 3A, and 3B. Mover actuator 96 has an exterior surface 98 that can include indicia 100 (e.g., PUSH) to provide instruction regarding operation. Locking tab 28 of closure-release control mechanism 18 is coupled to element hinge 52 of vial 12 at location 102 in an illustrative embodiment. It is also within the scope of this disclosure to couple locking tab 28 to a portion of movable release element 20 at a location near element hinge 52 to allow movement of locking tab 28 relative to movable release element 20.

Figure 4:
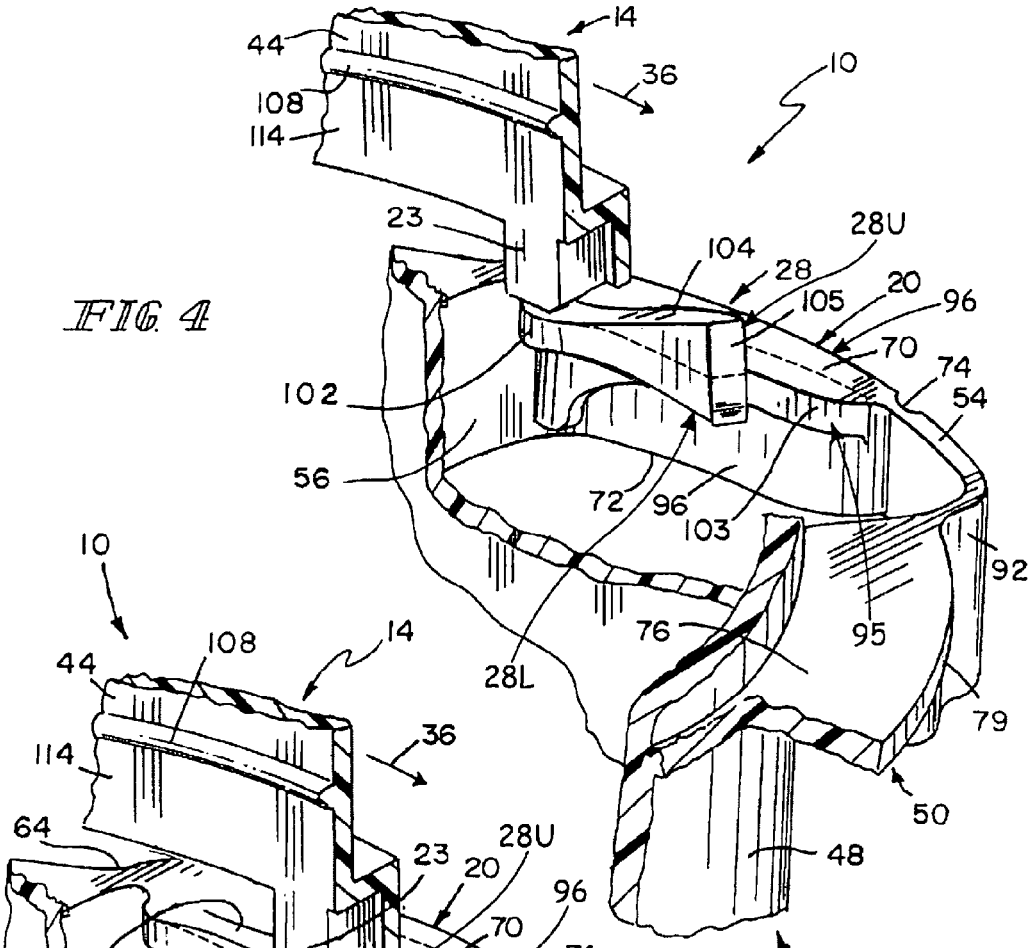

Locking tab 28 is configured to move independently of movable release element 20 about horizontal pivot axis 28H when closure 14 is attached to vial 12, as shown in FIGS. 4 and 5. Locking tab 28 is also configured to move with movable release element 20 and relative to annular side wall 48 about vertical pivot axis 28V in a radially inward direction 38 to allow removal of closure 14 from vial 12, as suggested in FIGS. 7 and 12-13.

Figure 8:
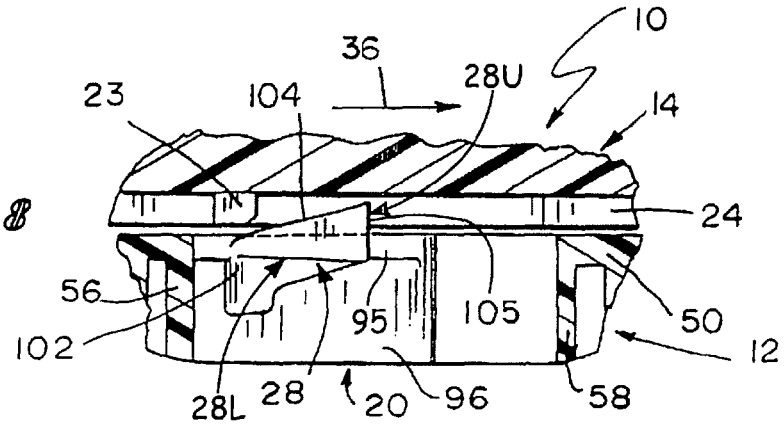
FIGS. 8-10 show relative movement of the rotation-blocking stop of the closure and the locking tab of the closure-release control mechanism during the installation of the closure on the vial.
Figure 9:
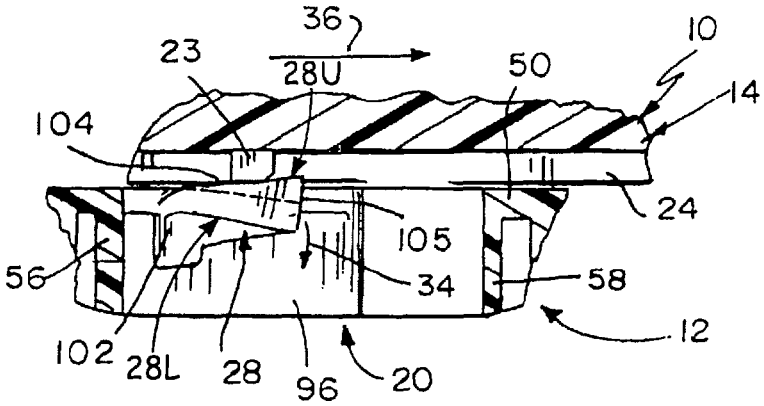
Figure 10:
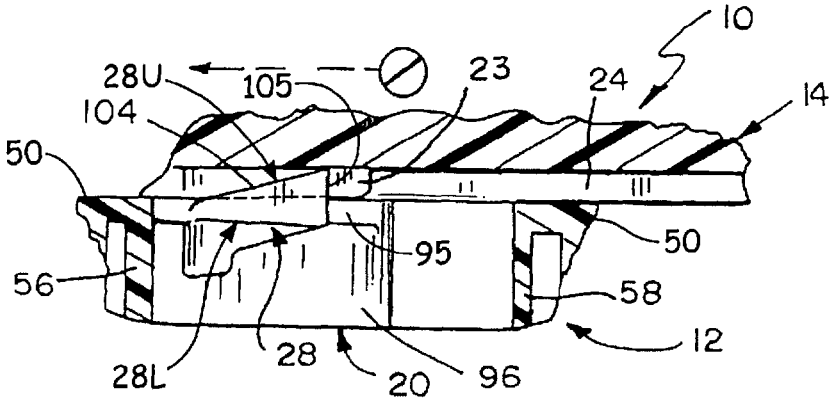

Locking tab 28 is configured to engage one of rotation-blocking stops 22, 23 included in closure 14 to block removal of closure 14 from vial 12 until a radially inwardly directed push force 30 is applied to mover actuator 96 of movable release element 20, as shown sequentially in FIGS. 4-7. Rotation of closure 14 in a clockwise closure-installation direction 36 causes rotation-blocking stops 22, 23 to engage locking tab 28 to cause locking tab 28 to deflect and move about horizontal pivot axis 28H in downward direction 34, as shown in FIGS. 8-10. Downward movement of locking tab 28 by rotation-blocking stops 22, 23 about horizontal pivot axis 28H does not cause movement of movable release element 20 relative to annular side wall 48. Application of radially inwardly directed push force 30 to movable release element 20 by a consumer causes locking tab 28 to move radially inwardly of rotation-blocking stops 22, 23 in direction 38 about vertical pivot axis 28V to allow for removal of closure 14 from vial 12, as shown in FIGS. 11-13.

Locking tab 28 includes sloped upper surface 104 and a stop surface 105. Sloped upper surface 104 is configured to be engaged by rotation-blocking stops 22, 23 of closure 12 during rotation of closure 14 in a clockwise closure-installation direction 36 on vial 12 to cause locking tab 28 to pivot downwardly in direction 34 about horizontal pivot axis 28H to allow rotation-blocking stops 22, 23 to move past locking tab 28 during installation of closure 14 onto vial 12, as shown, for example, in FIGS. 8-10.

Figure 11:
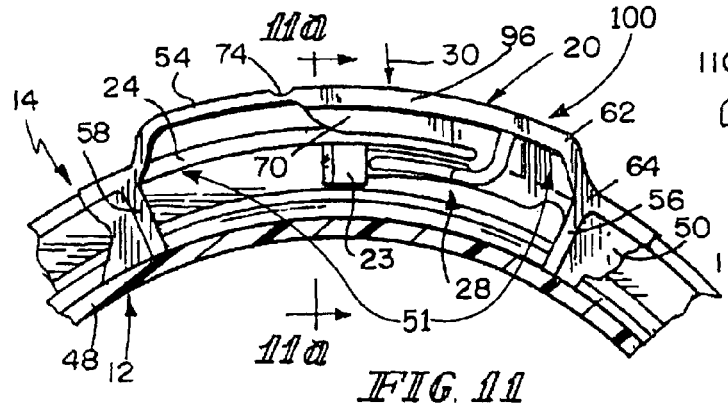
FIGS. 11-13 show relative movement of the release element and the locking tab to permit removal of the closure from the vial.
Figure 11A:
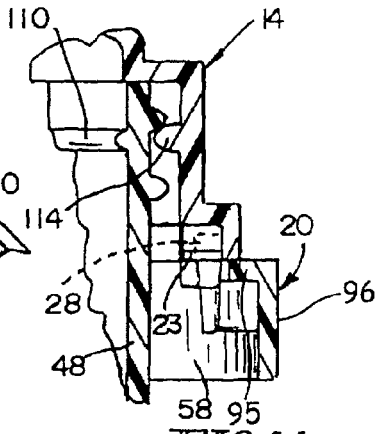
FIG. 11*a* is a sectional view of the child resistant closure taken along line 11*a*-11*a* of FIG. 11 showing the locking tab in the pathway of the rotation-blocking stop to block removal of the closure from the vial.

Element hinge 52 includes a first end 62 coupled to movable release element 20 and a second end 64 coupled, for example, to first wall member 56 and first tapered skirt 80, as shown in FIGS. 3 and 11. Element hinge 52 is configured to extend from a bottom edge 72 of movable release element 20 to a top wall 70 of movable release element 20 to provide support. Element hinge 52 flexes in response to movement of movable release element 20 in inward direction 38, as shown in FIG. 12.

Web 54 is a flexible member that extends from movable release element 20 to second wall member 58 and second tapered skirt 82, as shown in FIG. 3. Web 54 is configured to allow movable release element 20 to move in a radially inward direction 38 in response to a consumer pushing inwardly on mover actuator 96 of movable release element 20 in direction 30, as shown in FIG. 12. Movement of movable release element 20 in radially inward direction 38 causes movable release element 20 to engage locking tab 28 and thus causes radially inward movement of locking tab 28 as shown, for example, in FIG. 7.

A living hinge 74 is provided to interconnect web 54 and movable release element 20 to allow for pivotable movement of movable release element 20 relative to web 54 as suggested in FIGS. 11-13 during inward movement of movable release element 20.

Web 54 is coupled to living hinge 74 at a first end 90 thereof and to second wall member 58 and second tapered skirt 82 at a second end 92 thereof. Web 54 also includes a bottom edge 88 and a spaced apart top edge 94. Web 54 is configured to extend from a bottom edge 72 of movable release element 20 to a top wall 70 of release element 20 to provide support. Living hinge 74 is a thinned wall section as suggested in FIGS. 3 and 11. Living hinge 74 prevents binding of web 54 when mover actuator 96 of movable release element 20 is depressed by a consumer.

Vial 12 also includes external thread segments 106 on filler neck 32 that correspond to and mate with internal thread segments 108 on closure 14 to allow closure 14 to be coupled to vial 12, as shown in FIG. 2. Vial also includes internal threads 110 that correspond to external threads 112 on closure 14 to allow closure 14 to be coupled to vial 12 in a non-child resistant mode. When closure 14 is in the non-child resistant mode, closure-release control mechanism 18 does not work to prevent removal of closure 14 from vial 12.

Rotation-blocking stops 22, 23 of closure-release control mechanism 18 are coupled to perimeter edge 24 of rim 26 of closure 14, as shown, for example, in FIG. 2. Closure 14 includes a round top wall 42 and an annular side wall 44 that depends from top wall 42. Top wall 42 and side wall 44 form an interior region 46 of closure 14. Side wall 44 of closure 14 includes an inner surface 114 that includes internal thread segments 108. Internal thread segments 108 are configured to engage external thread segments 106 of vial 12. Rotation-blocking stops 22, 23 are positioned on rim 26 to lie beneath internal thread segments 108 so that rotation-blocking stops 22, 23 can engage with pivotable locking tab 28 to block the counterclockwise rotation and removal of closure 14 from vial 12, as suggested in FIG. 6.

Side wall 44 of cap 40 includes an exterior surface 116 that includes external thread segments 112 configured to engage internal thread segments 110 of vial 12, as shown in FIG. 2. Exterior surface 116 of side wall 44 also includes grip 118. Grip 118 is formed to include a series of vertical grooves 120 that assist a consumer in removing closure 14 from vial 12 when movable release element 20 is depressed in direction 30 by a consumer.

During installation of closure 14 in clockwise closure-installation direction 36 onto vial 12 rotation-blocking stop 23 moves toward sloped upper surface 104 of locking tab 28 as shown in FIGS. 3B and 4. Continued rotation of closure 14 in clockwise closure-installation direction 36 causes rotation-blocking stop 23 to engage sloped upper surface 104 of locking tab 28 and move locking tab 28 about horizontal pivot axis 28H in downward direction 34, as shown in FIGS. 5 and 9. Continued rotation of closure 14 causes rotation-blocking stop 23 to move past locking tab 28, resulting in locking tab 28 snapping back to its original position owing, in part, to elasticity of locking tab 28, as shown in FIGS. 6 and 10. With locking tab 28 in its original position, the pathway for rotation-blocking stop 23 is blocked and closure 14 cannot be removed from vial 12.

Figure 12A:
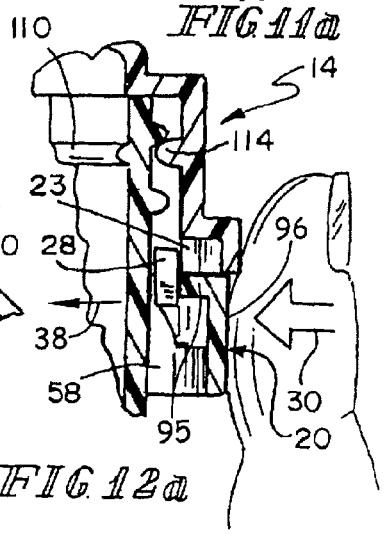
FIG. 12*a* is a sectional view similar to FIG. 11 a showing the locking tab positioned to lie radially inwardly of the rotation-blocking stop to permit removal of the closure.

Once closure 14 is coupled to vial 12 it cannot be removed unless the movable release element 20 is pushed radially inwardly in direction 30 by a consumer. This is because locking tab 28 of closure-release control mechanism 18 is blocking the pathway of rotation-blocking stop 23, as shown in FIGS. 10 and 11. To remove closure 14 from vial 12, movable release element 20 is pushed in radially inward direction 30, as shown in FIGS. 7, 12 and 12*a*. Movement of movable release element 20 engages and causes inward movement of locking tab 28 in direction 38 so that locking tab 28 clears the pathway of rotation-blocking stop 23 on closure 14. Once locking tab 28 is positioned inwardly of rotation-blocking stop 23, closure 14 can be rotated in a counterclockwise closure-removal direction 124 to permit removal of closure 14 from vial 12.

Child-resistant package 10 comprises a vial 12, a closure 14, and a closure-release control mechanism 18 as shown, for example, in FIGS. 2 and 3B. Vial 12 is formed to include a product-storage 16 chamber and a mouth 15 opening into product-storage chamber 16. Closure 14 is configured to mount on vial 12 to assume an installed position closing mouth 15 formed in vial 12 when rotated relative to vial 12 about a vertical axis of rotation 17 in a clockwise closure-installation direction 36.

Closure-release control mechanism 18 comprises a rotation-blocking stop 23 coupled to closure 14 to rotate therewith about vertical axis of rotation 17 during installation of closure 14 on vial 12 and removal of closure 14 from vial 12, a movable release element 20 mounted on vial 12 for radial movement relative to vial 12 toward vertical axis of rotation 17, and a locking tab 28 located between vial 12 and movable release element 20. Locking tab 28 is arranged to engage rotation-blocking stop 23 to block rotation of closure 14 about vertical axis of rotation 17 in a counterclockwise closure-removal direction 124 normally to retain closure 14 in the installed position on vial 12. Locking tab 28 includes a sloped upper surface 104 and a stop surface 105.

Locking tab 28 is mounted on vial 12 in illustrative embodiments for downward pivotable movement about a horizontal pivot axis 28H during exposure to a first pivot-inducing force applied to sloped upper surface 104 included in locking tab 28 by rotation-blocking stop 23 during rotation of closure 14 about vertical axis of rotation 17 in the clockwise closure-installation direction 36. This downward pivotable movement of locking tab 28 acts to free rotation-blocking stop 23 to confront stop surface 105 included in locking tab 28 upon arrival of closure 14 at the installed position on vial 12.

Locking tab 28 is mounted on vial 12 in illustrative embodiments also for pivotable movement about a vertical pivot axis 28V that is substantially perpendicular to horizontal pivot axis 28H during exposure to a second pivot-inducing force applied to locking tab 28 by movable release tab 20 during movement of movable release element 20 relative to vial 12 in a radially inward direction 30 toward vertical axis of rotation 17 to move stop surface 105 included in locking element 28 away from confronting relation with rotation-blocking stop 23. Such movement of stop surface 105 acts to locate locking tab 28 between vertical axis of rotation 17 and rotation-blocking stop 23 to free closure 14 for rotation about vertical axis of rotation 17 in counterclockwise closure-removal direction 124 relative to vial 12 during removal of closure 14 from vial 12.

Locking tab 28 includes an upper portion 28U including sloped upper surface 104 and stop surface 105. Locking tab 28 further includes a lower portion 28L coupled to upper portion 28U and arranged to underlie upper portion 28U.

Movable release element 20 includes a tab mover 95 and a mover actuator 96 as suggested in FIG. 3A. Tab mover 95 is arranged to lie in confronting relation to lower portion 28L of locking tab 28 upon movement of closure 14 relative to vial 12 to assume the installed position. Mover actuator 96 is coupled to tab mover 95 and arranged to locate tab mover 95 between mover actuator 96 and vertical axis of rotation 17. Mover actuator 96 is configured to provide means for moving tab mover 95 toward vertical axis of rotation 17 to apply the second pivot-inducing force to an outer side wall of lower portion 28L that is arranged to confront tab mover 95 to pivot locking tab 28 about vertical pivot axis 28V to cause stop surface 105 on upper portion 28U to move toward vertical axis of rotation to disengage rotation-blocking stop 23 so that closure 14 is freed to be rotated about vertical axis of rotation 17 by a user in the counterclockwise closure-removal direction 124 during removal of closure 14 from vial 12.

Vial 12 includes an annular side wall 28, a floor 49 coupled to annular side wall 48 and arranged to cooperate with annular side wall 48 to form product-storage chamber 16, and element-support means 51 coupled to annular side wall 48 for supporting movable release element 20 for radial movement relative to vertical axis of rotation 17 and annular side wall 48 as suggested in FIGS. 3B, 11, and 13. Element-support means 51 includes a first wall member 56 coupled to vial 12, an element hinge 52 coupled to first wall member 51 and to a root end of movable release element 20, a second wall member 58 coupled to vial 12 and arranged to lie in spaced-apart relation to first wall member 56, and a web 54 coupled to second wall 58 and to a living hinge 74 provided at a free end of movable release element 20 to establish a pivot joint between web 54 and movable release element 20.

Exterior portions of web 54 and movable release element 20 cooperate to form a convex surface 100 facing away from annular side wall 48 of vial 12 upon movement of closure 14 to the installed position on vial 12 as suggested in FIG. 11. Those exterior portions cooperate to form a concave surface 101 facing away from annular side wall 48 of vial 12 in response to movement of tab mover 95 toward vertical axis of rotation 17 to engage outer side wall of lower portion 28L of locking tab 28 as suggested in FIGS. 12 and 13.

First wall member 56, element hinge 52, movable release element 20, living hinge 74, web 54, and second wall member 58 are arranged, in series, to form a U-shaped strip cooperating with an exterior portion of annular side wall 48 of vial 12 to form a cavity 25 therebetween as suggested in FIGS. 3A and 3B. Lower portion 28L of locking tab 28 lies in cavity between the exterior portion of annular side wall 48 of vial 12 and mover actuator 96. Tab mover 95 lies in cavity between lower portion 28L of locking tab 28 and mover actuator 96.

Web 54 and second end wall 58 cooperate to form a tether having a first end coupled to annular side wall 48 and an opposite second end. A living hinge 74 interconnects the opposite second end of tether 54, 58 and a free end of movable release element 20 to establish a pivot joint therebetween.

A panel 540 included in tether 54, 58 and coupled to living hinge 74 cooperates with movable release element 20 to form a V-shaped structure in response to movement 95 of tab mover toward vertical axis of rotation 17 to engage outer side wall of lower portion 28L of locking tab 28. The V-shaped structure is arranged to open in a direction away from annular side wall 48 as suggested in FIGS. 12 and 13.

In use, a pharmacist fills product-storage chamber 16 of vial with prescription medication and screws closure 14 onto filler neck 32 of vial 12 in clockwise closure-installation direction 36. Rotation of closure 14 onto vial 12 in clockwise closure-installation direction 36 causes rotation blocking stop 23 to engage upper sloped surface 104 of locking tab 28 and move locking tab 28 in a downward direction 34, out of the pathway of rotation-blocking stop 23, as shown in FIGS. 4 and 5. Continued rotation of closure 14 in clockwise closure-installation direction 36 causes rotation-blocking stop 23 to move past locking tab 28, allowing locking tab 28 to spring back and block the closure-removal pathway of rotation-blocking stop 23, as shown in FIG. 6.

To remove closure 14 from vial 12, to allow access medicine stored within product-storage chamber 16 of vial 12, a consumer pushes movable release element 20 radially inwardly in direction 30, as shown in FIGS. 7 and 12. Inward movement of movable release element 20 causes movable release element 20 to engage and move locking tab 28 radially inwardly in direction 38 to move locking tab 28 out of the pathway of rotation-blocking stop 23. Once locking tab 28 is positioned to lie radially inwardly of rotation-blocking stop 23 on closure 14, closure 14 can be rotated in counterclockwise closure-removal direction 124 to permit removal of closure 14 from vial 12.

In the event that a consumer does not want to use the child-resistant feature, the consumer flips closure 14 over and couples closure 14 to vial 12 by using threads 110, 112. In this configuration, rotation-blocking stops 22, 23 cannot engage locking tab 28 of closure-release control mechanism 18. This configuration can be used when child-resistant package 10 is used in households without children.

The invention claimed is:

1. A child-resistant package comprises a vial formed to include a product-storage chamber and a mouth opening into the product-storage chamber, a closure configured to mount on the vial to assume an installed position closing the mouth formed in the vial when rotated relative to the vial about a vertical axis of rotation in a clockwise closure-installation direction, and a closure-release control mechanism comprising a rotation-blocking stop coupled to the closure to rotate therewith about the vertical axis of rotation during installation of the closure on the vial and removal of the closure from the vial, a movable release element mounted on the vial for radial movement relative to the vial toward the vertical axis of rotation, and a locking tab located between the vial and the movable release element and arranged to engage the rotation-blocking stop to block rotation of the closure about the vertical axis of rotation in a counterclockwise closure-removal direction normally to retain the closure in the installed position on the vial, the locking tab including a sloped upper surface and a stop surface, wherein the locking tab is mounted on the vial for pivotable movement about a horizontal pivot axis during exposure to a first pivot-inducing force applied to the sloped upper surface included in the locking tab by the rotation-blocking stop during rotation of the closure about the vertical axis of rotation in the clockwise closure-installation direction to free the rotation-blocking stop to confront the stop surface included in the locking tab upon arrival of the closure at the installed position on the vial, wherein the locking tab is mounted on the vial also for pivotable movement about a vertical pivot axis that is substantially perpendicular to the horizontal pivot axis during exposure to a second pivot-inducing force applied to the locking tab by the movable release element during movement of the movable release element relative to the vial in a radially inward direction toward the vertical axis of rotation to move the stop surface included in the locking tab away from confronting relation with the rotation-blocking stop to locate the locking tab between the vertical axis of rotation and the rotation-blocking stop to free the closure for rotation about the vertical axis of rotation in the counterclockwise closure-removal direction relative to the vial during removal of the closure from the vial; and wherein the moveable release element is coupled to first and second wall members which are configured to prevent any downward movement of the moveable release element when the moveable release element is moved in the radially inward direction.

2. The package of claim 1, wherein the locking tab includes an upper portion including the sloped upper surface and the stop surface, the locking tab further includes a lower portion coupled to the upper portion and arranged to underlie the upper portion, the movable release member includes a tab mover arranged to lie in confronting relation to the lower portion of the locking tab upon movement of the closure relative to the vial to assume the installed position and a mover actuator coupled to the tab mover and arranged to locate the tab mover between the mover actuator and the vertical axis of rotation, and the mover actuator is configured to provide means for moving the tab mover toward the vertical axis of rotation to apply the second pivot-inducing force to an outer side wall of the lower portion that is arranged to confront the tab mover to pivot the locking tab about the vertical pivot axis to cause the stop surface on the upper portion to move toward the vertical axis of rotation to disengage the rotation-blocking stop so that the closure is freed to be rotated about the vertical axis of rotation by a user in the counterclockwise closure-removal direction during removal of the closure from the vial.

3. The package of claim 2, wherein the vial includes an annular side wall, a floor coupled to the annular side wall and arranged to cooperate with the annular side wall to form the product-storage chamber, and element-support means coupled to the annular side wall for supporting the movable release element for radial movement relative to the vertical axis of rotation and the annular side wall, and wherein the element-support means includes a first wall member coupled to the vial, an element hinge coupled to the first wall member and to a root end of the movable release element, a second wall member coupled to the vial and arranged to lie in spaced-apart relation to the first wall member, and a web coupled to the second wall and to a living hinge provided at a free end of the movable release element to establish a pivot joint between the web and the movable release element.

4. The package of claim 3, wherein exterior portions of the web and the movable release element cooperate to form a convex surface facing away from the annular side wall of the vial upon movement of the closure to the installed position on the vial and cooperate to form a concave surface facing away from the annular side wall of the vial in response to movement of the tab mover toward the vertical axis of rotation to engage the outer side wall of the lower portion of the locking tab.

5. The package of claim 3, wherein the first wall member, element hinge, movable release element, web, and second wall member are arranged, in series, to form a U-shaped strip cooperating with an exterior portion of the annular side wall of the vial to form a cavity therebetween, the lower portion of the locking tab lies in the cavity between the exterior portion of the annular side wall of the vial and the mover actuator, and the tab actuator lies in the cavity between the lower portion of the locking tab and the mover actuator.

6. The package of claim 2, wherein the vial includes an annular side wall, a floor coupled to the annular side wall and arranged to cooperate with the annular side wall to form the product-storage chamber, a tether having a first end coupled to the annular side wall and an opposite second end, and a living hinge interconnecting the opposite second end of the tether and a free end of the movable release element to establish a pivot joint therebetween.

7. The package of claim 6, wherein a panel included in the tether and coupled to the living hinge cooperates with the movable release element to form a V-shaped structure in response to movement of the tab mover toward the vertical axis of rotation to engage the outer side wall of the lower portion of the locking tab.

8. The package of claim 1, wherein the vial includes an annular side wall, a floor coupled to the annular side wall and arranged to cooperate with the annular side wall to form the product-storage chamber, and element-support means coupled to the annular side wall for supporting the movable release element for radial movement relative to the vertical axis of rotation and the annular side wall, and wherein the element-support means includes a first wall member coupled to the vial, an element hinge coupled to the first wall member and to a root end of the movable release element, a second wall member coupled to the vial and arranged to lie in spaced-apart relation to the first wall member, and the web coupled to the second wall and to a free end of the movable release element to establish a pivot joint via a living hinge between the web and the movable release element.

9. The package of claim 8, wherein exterior portions of the web and the movable release element cooperate to form a convex surface facing away from the annular side wall of the vial upon movement of the closure to the installed position on the vial and cooperate to form a concave surface facing away from the annular side wall of the vial in response to exposure of the locking tab to the second pivot-inducing force.

10. A child-resistant package comprises a vial formed to include a product-storage chamber and a mouth opening into the product-storage chamber, a closure configured to mount on the vial to assume an installed position closing the mouth formed in the vial when rotated relative to the vial about a vertical axis of rotation in a clockwise closure-installation direction, a closure-release control mechanism comprising a rotation-blocking stop coupled to the closure to rotate therewith about the vertical axis of rotation during installation of the closure on the vial and removal of the closure from the vial, a locking tab cantilevered to the vial to lie outside of the product-storage chamber and in spaced-apart relation to the vertical axis of rotation, and a movable release element mounted on the vial for movement toward and away from the vertical axis of rotation and to locate the locking tab between the movable release element and the vertical axis of rotation, wherein the movable release element is arranged to be moved radially inwardly toward the vertical axis of rotation to engage and move the locking tab toward the vertical axis of rotation to disengage the rotation-blocking stop to locate the locking tab between the vertical axis of rotation and the rotation-blocking stop to free the closure for rotation about the vertical axis of rotation in a counterclockwise closure-removal direction relative to the vial during removal of the closure from the vial, wherein the locking tab includes an outer surface facing the movable release element, which outer surface cooperates with an inner surface of the movable release element to form a gap when the moveable release element is in a first position, and when the movable release element is moved in the radially inward direction to be in a second position, a free end of the locking tab engages the movable release element and closes a portion of the gap, and wherein the movable release element is coupled to first and second wall members which are configured to prevent any downward movement of the movable release element when the movable release element is moved in the radially inward direction.

11. The child-resistant package of claim 10, wherein the locking tab is mounted on the vial for pivotable movement about a horizontal pivot axis during exposure to a first pivot-inducing force applied to a sloped upper surface included in the locking tab by the rotation-blocking stop during rotation of the closure about the vertical axis of rotation in the clockwise closure-installation direction to free the rotation-blocking stop to confront a stop surface included in the locking tab upon arrival of the closure at the installed position on the vial and wherein the locking tab is mounted on the vial also for pivotable movement about a vertical pivot axis that is substantially perpendicular to the horizontal pivot axis during exposure to a second pivot-inducing force applied to the locking tab by the movable release element during movement of the movable release element relative to the vial in a radially inward direction toward the vertical axis of rotation to move the stop surface included in the locking tab away from confronting relation with the rotation-blocking stop.

12. A child-resistant package comprises a vial formed to include a product-storage chamber and a mouth opening into the product-storage chamber, a closure configured to mount on the vial to assume an installed position closing the mouth formed in the vial when rotated relative to the vial about a vertical axis of rotation in a clockwise closure-installation direction, and a closure-release control mechanism comprising a rotation-blocking stop coupled to the closure to rotate therewith about the vertical axis of rotation during installation of the closure on the vial and removal of the closure from the vial, a movable release element mounted on the vial for radial movement relative to the vial toward the vertical axis of rotation, and a locking tab located between the vial and the movable release element and arranged to engage the rotation-blocking stop to block rotation of the closure about the vertical axis of rotation in a counterclockwise closure-removal direction normally to retain the closure in the installed position on the vial, the locking tab including a sloped upper surface and a stop surface, wherein the locking tab is mounted on the vial for pivotable movement about a horizontal pivot axis during exposure to a first pivot-inducing force applied to the sloped upper surface included in the locking tab by the rotation-blocking stop during rotation of the closure about the vertical axis of rotation in the clockwise closure-installation direction to free the rotation-blocking stop to confront the stop surface included in the locking tab upon arrival of the closure at the installed position on the vial, wherein the locking tab is mounted on the vial also for pivotable movement about a vertical pivot axis that is substantially perpendicular to the horizontal pivot axis during exposure to a second pivot-inducing force applied to the locking tab by the movable release element during movement of the movable release element relative to the vial in a radially inward direction toward the vertical axis of rotation to move the stop surface included in the locking tab away from confronting relation with the rotation-blocking stop to locate the locking tab between the vertical axis of rotation and the rotation-blocking stop to free the closure for rotation about the vertical axis of rotation in the counterclockwise closure-removal direction relative to the vial during removal of the closure from the vial; and wherein the vial includes a release element support configured to support the movable release element and the release element support is coupled to an exterior surface of the vial via first and second wall members of the release element support, and the movable release element is coupled to the first and second wall members which are configured such that the first and second wall members prevent any downward movement of the movable release element when the movable release element is moved in the radially inward direction.

13. The package of claim 1, wherein the locking tab includes an outer surface facing the movable release element, which outer surface cooperates with an inner surface of the movable release element to form a gap when the movable release element is in a first position, and when the movable release element is moved in the radially inward direction to be in a second position, a free end of the locking tab engages the movable release element and closes a portion of the gap.

* * * * *